United States Patent [19]

Dunphy et al.

[11] 4,387,918

[45] Jun. 14, 1983

[54] DEADLOCK MECHANISM

[75] Inventors: Gerald F. Dunphy, Glen Waverley; Hans J. Esser, Keysborough, both of Australia

[73] Assignee: Ogden Industries Pty. Ltd., Huntingdale, Australia

[21] Appl. No.: 126,948

[22] Filed: Feb. 28, 1980

Related U.S. Application Data

[63] Continuation-in-part of Ser. No. 123,068, Feb. 20, 1980, abandoned.

[30] Foreign Application Priority Data

Feb. 28, 1979 [AU] Australia ..... PD7850

[51] Int. Cl.[3] ..... E05C 3/16; E05B 65/06

[52] U.S. Cl. ..... 292/224; 70/139; 292/199; 292/226; 292/229

[58] Field of Search ..... 292/224, 226, 222, 229, 292/196, 197, 199, 5-7; 70/135-137, 139, 416, 418

[56] References Cited

U.S. PATENT DOCUMENTS

| | | | |
|---|---|---|---|
| 2,145,982 | 2/1939 | Henning | 292/226 X |
| 2,989,859 | 6/1961 | Eads | 292/5 X |
| 3,695,068 | 10/1972 | Eads et al. | 292/5 X |
| 4,050,272 | 9/1977 | Tanaka | 70/137 X |
| 4,127,016 | 11/1978 | Ibsen | 70/139 X |

*Primary Examiner*—William E. Lyddane

*Attorney, Agent, or Firm*—Berman, Aisenberg & Platt

[57] ABSTRACT

Deadbolt mechanism for holding a door in a closed position and including a deadbolt pivotally connected to the mechanism housing for movement into and out of that housing to adopt inoperative and operative positions respectively. A pin tumbler lock is used to operate the deadbolt and the lock barrel is rotated through 360° during the change of deadbolt positions whereas the deadbolt swings through 90° only. The drive between the lock barrel and deadbolt includes a pair of gear segments which engage during the 90° travel of the deadbolt and are otherwise disengaged to permit the lock barrel to rotate free of the deadbolt. The drive also includes a pivoted arm which locates between side walls of the deadbolt and has a laterally extending pin slideably locating within a slot in each of the side walls. When the gear segments are engaged the arm is swung such that a camming action occurs between the pin and cooperating slots whereby the deadbolt is caused to move about its pivot. The pin moves along the slots in one direction and then back again during each change of deadbolt position. A biassing spring is also located between the deadbolt side walls. A deflector plate is secured to the lower edge of the deadbolt and a transverse slot in the upper edge of the deadbolt receives an edge portion of a housing wall in the operative position of the deadbolt.

7 Claims, 4 Drawing Figures

DEADLOCK MECHANISM

This application is a continuation-in-part of application Ser. No. 123,068, filed 2/20/80 which is now abandoned.

This invention relates generally to deadlocking mechanisms and more particularly although not exclusively to mechanisms which includes a swinging bolt; that is a bolt which is mounted for pivotal movement between operative and inoperative positions. In the operative position the bolt is adapted to project into a strike or similar member and in the inoperative position the bolt may be contained within a housing. It will be hereinafter convenient to describe the invention with reference to mechanisms of this type.

The main advantage of a swinging bolt deadlock mechanism is that it enables the bolt to project outwardly from its housing and into the strike a far greater distance than other types of bolts. This can be particularly advantageous for security purposes. One method of forced entry through a locked door is to drive a wedge between the door and the frame so as to distort both sufficiently to disengage the bolt from the strike. Swinging bolts tend to prevent this form of forced entry due to their long throw capability.

Nevertheless, swing bolt deadlock mechanisms do suffer from several disadvantages. Generally, the swinging bolt is actuated by a key operated pin tumbler lock barrel. To effect movement of the bolt the key is rotated in one direction to the limit of the action thereby causing the bolt to swing into its operative position. The key is then returned to its original position so that it can be withdrawn from the pin tumbler lock barrel. This return movement is generally effected by provision of some form of lost motion which enables the key to be returned to its original position without causing corresponding movement of the bolt which therefore remains in its operative position. This type of mechanism suffers the problems that the bolt may not be totally moved into its operative position, and that incomplete movement may not be detected by the operator. Such incomplete movement may be caused by slight distortions between the door and the frame, or be laziness of the operator in not completing the movement of the key. If the bolt is only partially moved towards the operative position it can be susceptible to forced movement back into its inoperative position thereby creating a security risk.

It is therefore a primary object of the present invention to provide an improved deadlocking mechanism which alleviates or overcomes the aforementioned problem.

According to the present invention, there is provided a deadlock mechanism including a housing, a deadbolt pivotally mounted on said housing for movement between an operative position and an inoperative position, a front portion of said deadbolt projecting out of said front portion of said deadbolt projecting out of said housing in said operative position and being substantially contained within said housing in said inoperative position, a cavity formed in a rear portion of said deadbolt two side walls of said deadbolt each defining a respective side of said cavity, a slot formed in each said side wall and extending from an edge thereof towards said deadbolt pivotal mounting, a drive arm mounted on said housing for rotation about an axis substantially parallel to the pivotal axis of said deadbolt and projecting into said cavity, a coupling pin extending from each of two opposite sides of said drive arm and slidably locating within a respective one of said slots, each said coupling pin remaining within its respective said slot in both said positions of the deadbolt, and actuator means operable to cause rotation of said drive arm in either of two directions whereby each said coupling pin is engaged with a side of the respective said slot to urge said deadbolt to move about said pivotal mounting.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Basically, the deadlock mechanism of the present invention comprises an actuator 1 which is operatively connected to a deadbolt 2 by means of a drive connection which maintains a positive connection between the actuator 1 and deadbolt 2 for a predetermined part of the deadbolt movement between the operative and inoperative positions so that movement of the actuator 1 through that part in either direction will cause corresponding movement of the deadbolt. The actuator 1 preferably moves through 360° in transferring the deadbolt 2 from the operative to the inoperative position, or vice versa, and it is further preferred that the drive connection is disengaged during at least one part of the actuator movement through that 360°. Furthermore, in the case of a key operated actuator 1 as shown in the accompanying drawings, the key (not shown) is preferably removable from the lock barrel 3 only at one rotational portion of that barrel 3 relative to the associated cylinder 4, and in that position the deadbolt 2 is either in its operative or inoperative position according to the direction of movement of the actuator 1 beforehand.

Figure 1:
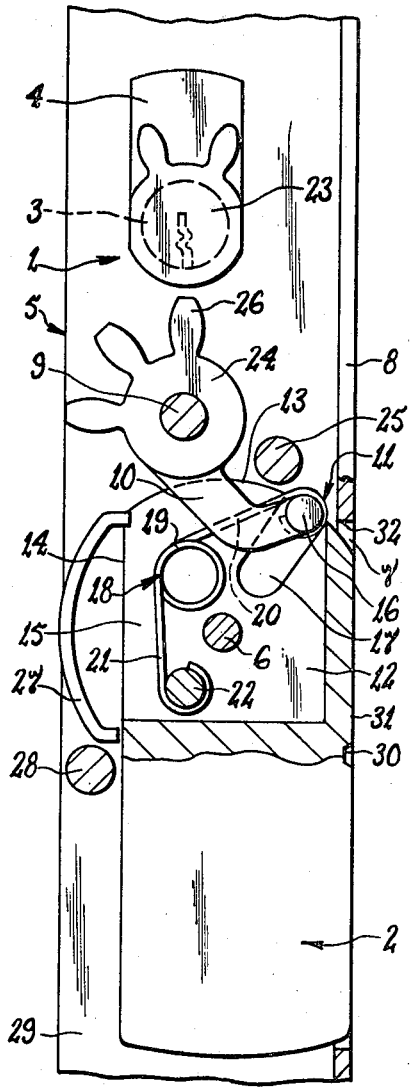
FIG. 1 is a partially sectioned side elevational view of a mechanism incorporating the present invention, part only of the mechanism housing being shown.
Figure 3:
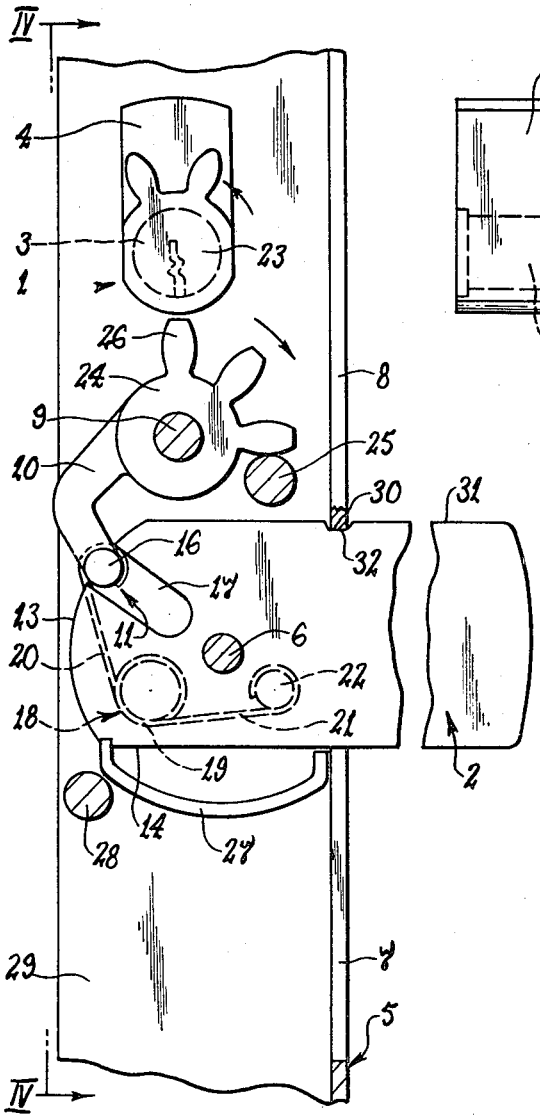
FIG. 3 is a view similar to FIG. 1 but showing the mechanism in the operative position.

In the particular arrangement shown, the deadlock mechanism includes a housing 5 to which the deadbolt 2 is pivotably mounted through pivot 6. The housing 5 may be of any convenient form and be adapted to be securable to a support (not shown) such as a door or the like. An opening 7 is provided in a front wall 8 of the housing 5 and the bolt 2 projects through that opening 7 when in its operative position, as shown in FIG. 3. The bolt 2 is contained substantially within the housing 5 when in its inoperative position as shown in FIG. 1.

The drive connection operatively connecting the actuator 1 to the deadbolt 2 is such that it automatically engages during a predetermined part of the actuator movement and automatically disengages for the remainder of that movement.

In a typical arrangement, the deadbolt 2 moves through substantially 90° when travelling between its operative and inoperative positions as against the 360° movement of the actuator 1. It is then preferred that the drive connection is disengaged on both sides of that part of the actuator movement which causes corresponding movement of the deadbolt.

Although the actuator 1 is preferably in the form of a key operated pin tumbler lock, it will be appreciated that other forms of actuating devices may be used. As previously stated, the tumbler lock is arranged so that the associated key can only be removed when the lock barrel 3 is in a particular rotational position which corresponds to either the operative or inoperative position of the deadbolt 2 (see FIGS. 3 and 1).

The drive connection shown includes a drive spindle 9 which is rotatably mounted on the housing 5 and is operatively connected to the deadbolt 2 so that rotation of the spindle 9 causes the deadbolt 2 to move between its operative and inoperative positions. The drive spindle 9 may be connected to the bolt 2 in any convenient manner but in a preferred arrangement shown that connection includes a drive arm 10 and a slideable pin and slot coupling 11 between the arm 10 and the deadbolt 2. The rotational axes of the deadbolt 2 and drive spindle 10 are not coincident so that the coupling 11 (or a functional equivalent) is necessary to compensate for the linear component of the drive arm movement relative to the deadbolt 2.

Figure 4:
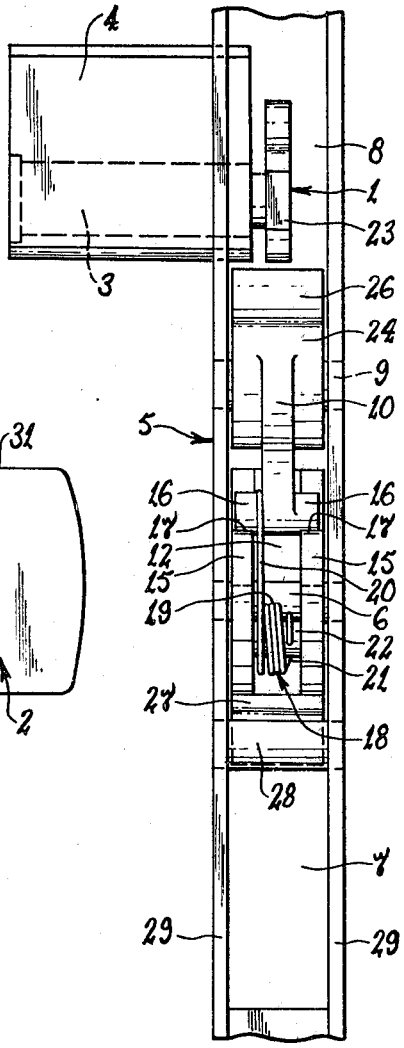
FIG. 4 is a view taken along line IV—IV of FIG. 3.

In the construction shown, the drive arm 10 is located within a cavity 12 formed within a rear portion of the deadbolt 2. The cavity 12 is open at the rear edge 13 and the lower edge 14 of the deadbolt 2 and is defined between two side walls 15 of the deadbolt 2 (see FIGS. 1 and 4). The drive arm 10 is dimensioned relative to the cavity 12 so as to be a slidable fit within that cavity. The coupling 11 includes a pin 16 at the outer end of the drive arm 10 and projecting laterally beyond both sides of the arm 10, and a slot 17 formed within each side wall 15. Each slot 17 extends from the bolt rear edge 13 towards the pivot 6 and slideably receives a respective end portion of the pin 16.

When the deadbolt 2 is in either its inoperative or operative position, the drive coupling pin 16 is located at one particular end of its stroke within the slots 17 of the deadbolt 2, and that is preferably the outer end of the slots 17 as shown in FIGS. 1 and 3. As the drive spindle 9 is rotated, movement of the drive arm 10 causes the deadbolt 2 to swing about its pivot 6 because of a camming action between the coupling pin 16 and the slots 17. During this movement, the pin 16 will move along the slots 17 towards their inner end until it reaches the end of its stroke, and it will then proceed to return to its original position at the outer end of the slots 17. In spite of that reversal of pin movement, the deadbolt 2 continues to swing in the one direction until it reaches either its operative or inoperative position, whichever is being sought.

Biassing means may be provided for the drive arm 10 and in the construction shown that is in the form of a spring 18 which is substantially contained in the cavity 12. The spring 18 includes a helical coil body (FIG. 4) and arms 20 and 21 extending laterally from opposite ends respectively of the body 19. One arm 20 is connected to the coupling pin 16 and the other arm 21 is connected to the deadbolt 2 through a mounting pin 22. The spring 18 is tensioned so that the arms 20 and 21 tend to move away from one another from the relative positions shown in FIG. 2—i.e., the coupling pin 16 is urged towards the outer end of the slots 17. When the deadbolt 2 is in the FIG. 2 position, there is a tendency for the spring 18 to urge the drive arm 10 in the anti-clockwise direction of rotation as viewed in FIG. 2. Because the axis of pin 16 is located to the left of an imaginary line joining the axes of pivot 6 and shaft 9 in FIG. 2, that tendency of spring 18 cause the spring 18 to encourage movement of the deadbolt 2 towards the operative position.

Figure 2:
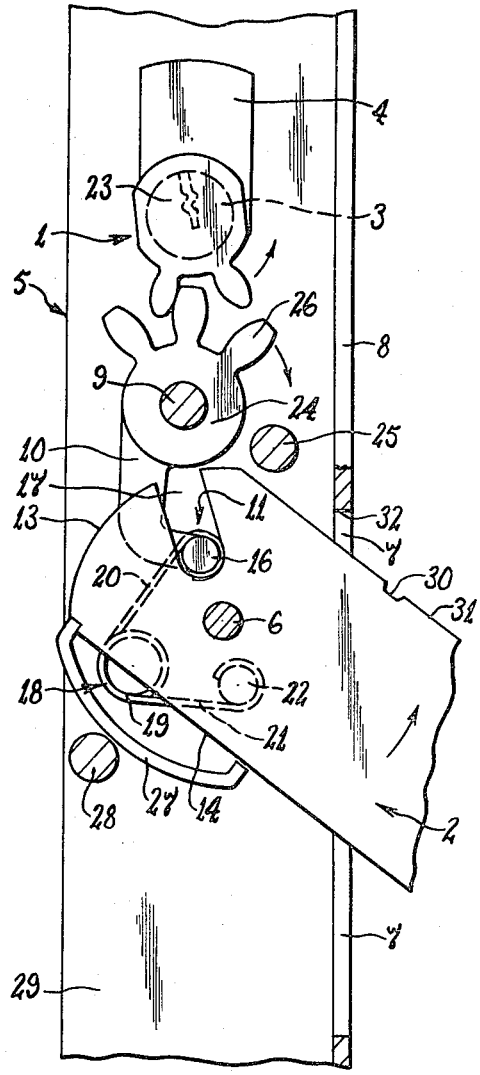
FIG. 2 is a view similar to FIG. 1 but showing the mechanism being moved from the inoperative to the operative position.

It will be appreciated that when the actuator 1 is operated to move the drive arm 10 from the FIG. 1 position towards the FIG. 2 position the spring 18 functions to resist that movement until the FIG. 2 position is reached. At the FIG. 2 position it is preferred that the arms 20 and 21 still tend to move away from one another, but as the deadbolt 2 travels beyond that position the coupling pin 16 is returned towards the outer end of the slots 17. Thus, the arms 20 and 21 are progressively moved apart again and at the FIG. 3 position the relative positions of the arms 20 and 21 are substantially the same as in the FIG. 1 position.

When the deadbolt 2 is moved from the FIG. 3 position to the FIG. 1 position, the spring 18 will function in the same manner as described above. With both directions of movement of the deadbolt 2, the spring 18 first resists movement of the drive arm 10 in the particular direction of corresponding movement and then subsequently encourages that movement of the drive arm 10.

In the preferred arrangement shown, the connection between the actuator 1 and the drive spindle 9 is effected by way of segmented spur gears 23 and 24. The segmented gear 23 is mounted for rotation with the lock barrel 3, the other spur gear 24 is mounted for rotation with the drive spindle 9. In an alternative however, the gear 24 may be rotatably mounted on the spindle 9 which is fixed. The spur gear segments 23 and and 24 are relatively arranged so that they cooperatively engage only during a specific section of the full rotational movement of the lock barrel 3 as will be seen from FIGS. 1 to 3. The length of the toothed portion of each gear segment 23 and 24 is selected so that the segments 23 and 24 will automatically disengage when the rotational position of the drive spindle 9 passes beyond positions corresponding to the operative and inoperative positions of the deadbolt 2.

Retaining means may be provided to releasably hold the deadbolt 2 in its operative position and in particular to inhibit forced movement of the deadbolt 2 from the operative to the inoperative position. In the form shown the retaining means comprises a stop 25 mounted on the housing 5 and adapted to cooperate with an abutment connected to the drive spindle 9. Conveniently, an end tooth 26 of the gear segment 24 defines the abutment (see FIG. 3). In addition at the operative position of the deadbolt 2, the coupling pin 16 is located at the outer end of the slots 17 and is arranged relative to the axis of the drive spindle 9 such that application of an external force tending to move the deadbolt 2 towards the inoperative position, will serve to drive the abutment gear tooth 26 more firmly against the stop 25 thereby inhibiting movement of the deadbolt 2. That is, in the operative position of the deadbolt 2, the pin 16 is located over centre with respect to the axis of the drive spindle 9. As may be seen from FIG. 3, a force vector operating on pin 16, created by the application of a downward force on the outer end of the bolt 2, passes close to the center of pin 9. The tooth 26 is driven against the stop 25, but the torque created by the force on pin 16 is so small that breakage of gear segment 24 is not likely.

The mechanism shown further includes deflector means to hinder any object being passed through the front opening 7 in the housing 5 so as to improperly influence the drive mechanism. In the form shown, the deflector means comprises an arcuate shaped plate 27 which is secured to the lower edge 14 of the deadbolt 2. Thus, when the deadbolt 2 is in the operative position, the plate 27 will deflect any object which may be passed through the lower exposed part of the opening 7 to hinder improper operation of the mechanism. A post 28 secured to and extending between the side walls 29 of the housing 5 is located so as to be adjacent the plate 27 in all positions of the deadbolt 2 and thereby aid in the security of the mechanism. Any other fixed part of the housing 5 may be substituted for the post 28 to achieve the same purpose.

As a further security measure, a transverse groove 30 may be provided in the upper edge 31 of the deadbolt 2. The groove 30 is positioned so that when the deadbolt 2 is in its operative position, an edge portion 32 of the housing front wall 8, or of a cover plate (not shown), locates within the groove 30. As a result there is no gap between the bolt upper edge 31 and the housing front wall 8 through which a tool can be inserted to improperly operate the mechanism.

The mechanism as described has substantial advantages over the prior art constructions in that it ensures that the deadbolt is in its full operative position when the actuator is in the lock position and also that it is in its inoperative position when the actuator is in its unlock position. In that regard movement of the lock barrel 3 through its 360° range of movement in either direction must necessarily cause appropriate movement of the deadbolt 2 because of the positive drive connection through the gear segments 23 and 24. In particular, return movement of the barrel 3 from partial completion of a locking movement must carry the deadbolt 2 back to the inoperative position. On the other hand, completion of the locking movement must place the deadbolt 2 fully in its operative position. Clearly, this arrangement provides a lock which gives a high condition of security.

It is to be understood that the inventive concept in any of its aspects can be incorporated in many different constructions so that the generality of the preceding description is not to be superseded by the particularity of the attached drawings. Various alterations modifications and/or additions may be incorporated into the invention without departing from the spirit or ambit of the invention as defined by the appended claims.

Having now described our invention what we claim as new and desire to secure by Letters Patent is:

1. Deadlock mechanism including a housing, a deadbolt pivotally mounted on said housing for movement between an operative position and an inoperative position, a front portion of said deadbolt projecting out of said housing in said operative position and being substantially contained within said housing in said inoperative position, a cavity formed in a rear portion of said deadbolt, two side walls of said deadbolt each defining a respective side of said cavity, a slot formed in each said side wall and extending from an edge thereof towards said deadbolt pivotal mounting, a drive arm mounted on said housing for rotation about an axis substantially parallel to the pivotal axis of said deadbolt and projecting into said cavity, a coupling pin extending from each of two opposite sides of said drive arm and slidably located within a respective one of said slots each said coupling pin remaining within its respective slot in both said positions of the deadbolt, and actuator means operable to cause rotation of said drive arm in either of two directions whereby each said coupling pin is engaged with a side of the respective said slot to urge said deadbolt to move about said pivotal mounting, further comprising a biasing spring which is substantially located within said cavity and acts between said deadbolt and said drive arm in a manner such that during movement of said deadbolt from one said position to the other, said spring first functions to resist movement of said drive arm in the direction corresponding to the movement of the deadbolt and subsequently functions to assist movement of said drive arm in that direction.

2. Deadlock mechanism according to claim 1, wherein said deadbolt has an upper edge and a lower edge which are substantially parallel and extend between the front and back of said deadbolt, said upper edge being the first of the two said edges which emerges from said housing during movement of said deadbolt towards said operative position, an opening is provided in a front wall of said housing and said deadbolt projects through said opening in said operative position, and a deflector is secured to the rear portion of said deadbolt to extend along said lower edge and to be substantially contained within said housing in the inoperative position of said deadbolt.

3. Deadlock mechanism according to claim 2 wherein said deflector curves outwardly from said lower edge at the end of the deflector which is adjacent said lower edge at the end of the deflector which is adjacent said front wall when said deadbolt is in the operative position.

4. Deadlock mechanism according to claim 3 wherein the outer surface of said deflector has a convex curvature between its ends spaced longitudinally of said lower edge, and said outer surface is adjacent a fixed part of said housing located remote from said front wall when said deadbolt is in either of its said positions.

5. Deadlock mechanism according to claims 1, 2, 3, or 4 wherein a transverse groove is provided in a longitudinal edge of said deadbolt and is operative to receive part of said housing when said deadbolt is in the operative position.

6. Deadlock mechanism according to claim 5, wherein said longitudinal edge is the upper edge of said deadbolt and said housing part is a part of said front wall defining an edge of said opening.

7. Deadlock mechanism including a housing, a deadbolt pivotally mounted on said housing for movement between an operative position and an inoperative position, a front portion of said deadbolt projecting out of said housing in said operative position and being substantially contained within said housing in said inoperative position, a cavity formed in a rear portion of said deadbolt, two side walls of said deadbolt each defining a respective side of said cavity, a slot formed in each said side wall and extending from an edge thereof towards said deadbolt pivotal mounting, a driven gear segment mounted on said housing for rotation about an axis substantially parallel to the pivotal axis of said deadbolt, an arm secured to said driven gear segment for rotation therewith and projecting into said cavity, a coupling pin extending from each of two opposite sides of said arm and slidably located within a respective one of said slots, each said coupling pin being located at the end of the respective said slot which is remote from said deadbolt pivotal mounting in both said operative and inoperative positions and twice traversing the full length of said slot during movement of said deadbolt between those positions, a drive gear segment rotatably mounted on said housing and being adapted to engage with said driven gear segment to cause rotation thereof only during that part of the drive gear segment rotation which corresponds to said deadbolt movement, stop means preventing rotation of said driven gear segment in one direction beyond the position thereof corresponding to said deadbolt operative position, and actuator means operable to cause rotation of said drive gear segment in either of two directions whereby each said coupling pin is engaged with a side of the respective said slot to urge said deadbolt to move about said pivotal mounting, said coupling pins being arranged relative to both the pivotal axis of said deadbolt and the rotational axis of said driven gear segment so that externally applied pressure tending to move said deadbolt from the operative to the inoperative position imposes a force on said coupling pins which acts along a line passing close to said rotational axis.

* * * * *